US005620233A

United States Patent [19]

Corwin

[11] Patent Number: 5,620,233

[45] Date of Patent: Apr. 15, 1997

[54] ADJUSTING MECHANISM FOR SELECTIVELY POSITIONING CHAIR COMPONENTS

[75] Inventor: Thomas D. Corwin, Centreville, Mich.

[73] Assignee: JAMI, Inc., Overland Park, Kans.

[21] Appl. No.: 471,912

[22] Filed: Jun. 7, 1995

[51] Int. Cl.[6] ..... A47C 7/54

[52] U.S. Cl. ..... 297/411.36; 297/353

[58] Field of Search ..... 297/353, 410, 297/411.36

[56] References Cited

U.S. PATENT DOCUMENTS

| | | | |
|---|---|---|---|
| 4,036,525 | 7/1977 | Howk | 297/353 |
| 4,221,430 | 9/1980 | Frobose | 297/353 |
| 4,639,039 | 1/1987 | Donovan | 297/353 |
| 5,265,938 | 11/1993 | Melhuish et al. | 297/411.36 |
| 5,286,088 | 2/1994 | Taylor et al. | 297/353 |
| 5,388,892 | 2/1995 | Tornero | 297/411.36 |
| 5,439,267 | 8/1995 | Peterson et al. | 297/411.36 |

*Primary Examiner*—Peter R. Brown

*Attorney, Agent, or Firm*—Litman, McMahon and Brown, L.L.C.

[57] ABSTRACT

An adjusting mechanism is provided for selectively positioning a chair component such as an armrest or a backrest. The adjusting mechanism utilizes a first member having a longitudinal axis. A plurality of ratchet recesses are spaced longitudinally along the first member. A second member having a longitudinal axis is disposed in substantially parallel relation with the longitudinal axis of the first member. The second member supports a ratchet dog. The first and second members are relatively movable along their longitudinal axes between a ratchet dog-blocking position and a ratchet dog-releasing position. A spring is mounted on the second member for urging the ratchet dog into successive engagement with the plurality of ratchet recesses. A slider is movably mounted on the second member for selectively displacing the spring to effect disengagement of the ratchet dog from the successive ratchet recesses.

8 Claims, 10 Drawing Sheets

ADJUSTING MECHANISM FOR SELECTIVELY POSITIONING CHAIR COMPONENTS

TECHNICAL FIELD

The present invention relates generally to adjustable components for furniture. More particularly, the present invention relates to a mechanism for adjusting the disposition of furniture components such as, for example, armrests and backrests. Specifically, the present invention relates to an adjusting mechanisms for chairs wherein the adjusting mechanism utilizes an unobtrusive ratcheting arrangement that automatically engages when the component to be adjusted is at its lowermost position and automatically disengages when the component is at its uppermost position.

BACKGROUND OF THE INVENTION

Chairs having adjustable armrests and/or backrests are highly desirable because they can be readily conformed to the body proportions and dimensions of the individuals using the chair. Such chairs can also be readily customized to provide the greatest comfort to the user in relation to the specific station at which the individual is working. Because of the universality of such adjustable chairs, one model may be sold to a wide variety of consumers, and for that reason production costs are significantly reduced. In summary, adjusting mechanisms for chairs permit selection of the height for seats, armrests and/or backrests. Various prior art mechanisms are presently available for accomplishing these adjustments.

One such prior known arrangement connects the component to be adjusted, such as the seat of a chair, to a base with a threaded rod that meshingly engages a threaded supporting block which is fixedly secured to the base. To adjust the height of the seat, the operator turns the seat with respect to the base and the seat is raised or lowered depending on the direction of rotation. The sensitivity of the adjustment depends on the angular inclination of the threads. Threaded rods, however, are not practical adjusting devices for all chair components not only because of their bulk but also because components such as armrests and backrests cannot be easily rotated.

Another known approach for adjusting the height of a chair component is to have one portion of a support member slidably received on another portion of the support member and provide a clamp to hold the two portions of the support member together. One such device utilizes a base column with a sleeve slidably disposed over the base column. A bolt is threadably received in the sleeve, and a handle is connected to the bolt. To lock the position of the sleeve with respect to the base column, the operator tightens the bolt against the column. To adjust the height of the sleeve, the bolt is loosened, the sleeve adjusted, and the bolt retightened. Devices employing such restraining means are undesirable because the degree of restraint depends on the force used to tighten the bolt.

One attempt to solve this problem has resulted in a base column having a plurality of holes within which the bolt may be selectively received. When the bolt is received in one of the holes, the restraining force is no longer dependant on the force used to tighten the bolt. One problem with this type of device is that the operator must align the bolt that penetrates the sleeve with the holes in the bar in order to adjust the component. The alignment requirement forces the operator to search blindly for the hole with one hand while supporting the weight of the component with the other hand.

Such an arrangement is, therefore, particularly undesirable for use with heavy chair components. Another problem with these devices is the amount of time required for the operator to perform the adjustment. A further problem is that each adjustable component has an unsightly knob protruding therefrom. The knobs must be large enough to provide a good grip tier the operator, but small enough to allow the chair to function. Still a further problem is that the threads in the sleeves can, with misuse, become stripped and render the adjusting mechanism inoperable.

A further attempt to solve the problems inherent in the prior art arrangements has been to incorporate a ratchet assembly in the adjusting mechanism. In these devices, a base structure presents a plurality of teeth which are to be engaged by a pawl. The pawl is mounted on a sleeve that is attached to the chair component. As the chair component is raised, the pawl engages successive teeth until the sleeve reaches its uppermost position. The operator then releases the pawl by pushing a button or operating a lever. When the pawl is disengaged, the sleeve may be lowered to the desired position whereupon the operator re-engages the pawl by releasing the lever or button. Devices incorporating such levers or buttons perform satisfactorily, but two problems of the prior art remain: the requirement that the operator push or manipulate something while making the adjustment; and, the protrusion caused by the lever or button.

The latest known attempt to overcome some of the problems found in the prior art is disclosed by U.S. Pat. No. 4,639,039 to Donovan. The Donovan device incorporates a ratchet mechanism that is set and reset when the device is translated between two limiting positions. One undesirable aspect of the Donovan device is that the complexity of the mechanism is such that it can only be of a size which prevents it from being unobtrusively built into the components of a chair. Thus, the appearance of the chair must be altered to incorporate the Donovan device. Another undesirable aspect of the device has been the cost and the relative difficulty of manufacturing all of the elements of the device.

SUMMARY OF THE INVENTION

It is, therefore, a primary object of the present invention to provide a novel mechanism for selectively adjusting chair components such as armrests and backrests by an unobtrusive ratcheting mechanism.

It is another object of the present invention to provide an adjusting mechanism that is operated without manipulating a trigger device such as a button or a lever.

It is a further object of the present invention to provide an adjusting mechanism comprising a ratchet assembly that becomes engaged at the lowermost point of travel of the chair component and becomes disengaged at the uppermost point of travel of the chair component.

It is still another object of the present invention to provide at least one embodiment of the adjusting mechanism wherein the ratchet assembly may be contained completely within the confines of the members by which the component to be adjusted is supported.

It is yet another object of the present invention to provide an adjusting mechanism that is of such compact size that it may be readily adapted for use with virtually any chair components.

These and other objects of the invention, as well as the advantages thereof over existing and prior art forms which will be apparent in view of the following detailed specification, are accomplished by means hereinafter described and claimed.

In general, a mechanism for adjusting chair components embodying the concepts of the present invention utilizes a first member having a longitudinal axis. A plurality of ratchet recess means are spaced longitudinally along the first member. A second member, also having a longitudinal axis, is disposed such that its longitudinal axis is substantially parallel with the longitudinal axis of the first member. The second member supports a ratchet dog. The first and second members are relatively movable along their longitudinal axes between a ratchet-engaging position and a ratchet-disengaging position. Spring means are mounted on the second member for urging the ratchet dog into successive engagement with the plurality of ratchet recess means in the first member. Slider means are movably mounted on the second member for selectively displacing the spring means to effect disengagement of the ratchet dog from the ratchet recess means.

To acquaint persons skilled in the arts most closely related to the present invention, a preferred embodiment, an alternative embodiment and a variation of the alternative embodiment for adjusting mechanisms for chair components that illustrate the best modes now contemplated for putting the invention into practice are described herein by, and with reference to, the annexed drawings that form a part of the specification. The exemplary adjusting mechanisms are described in detail without attempting to show all of the various forms and modifications in which the invention might be embodied. As such, the embodiments shown and described herein are illustrative, and as will become apparent to those skilled in these arts, can be modified in numerous ways within the spirit and scope of the invention; the invention being measured by the appended claims and not by the details of the specification.

DESCRIPTION OF AN EXEMPLARY EMBODIMENT

Figure 1:
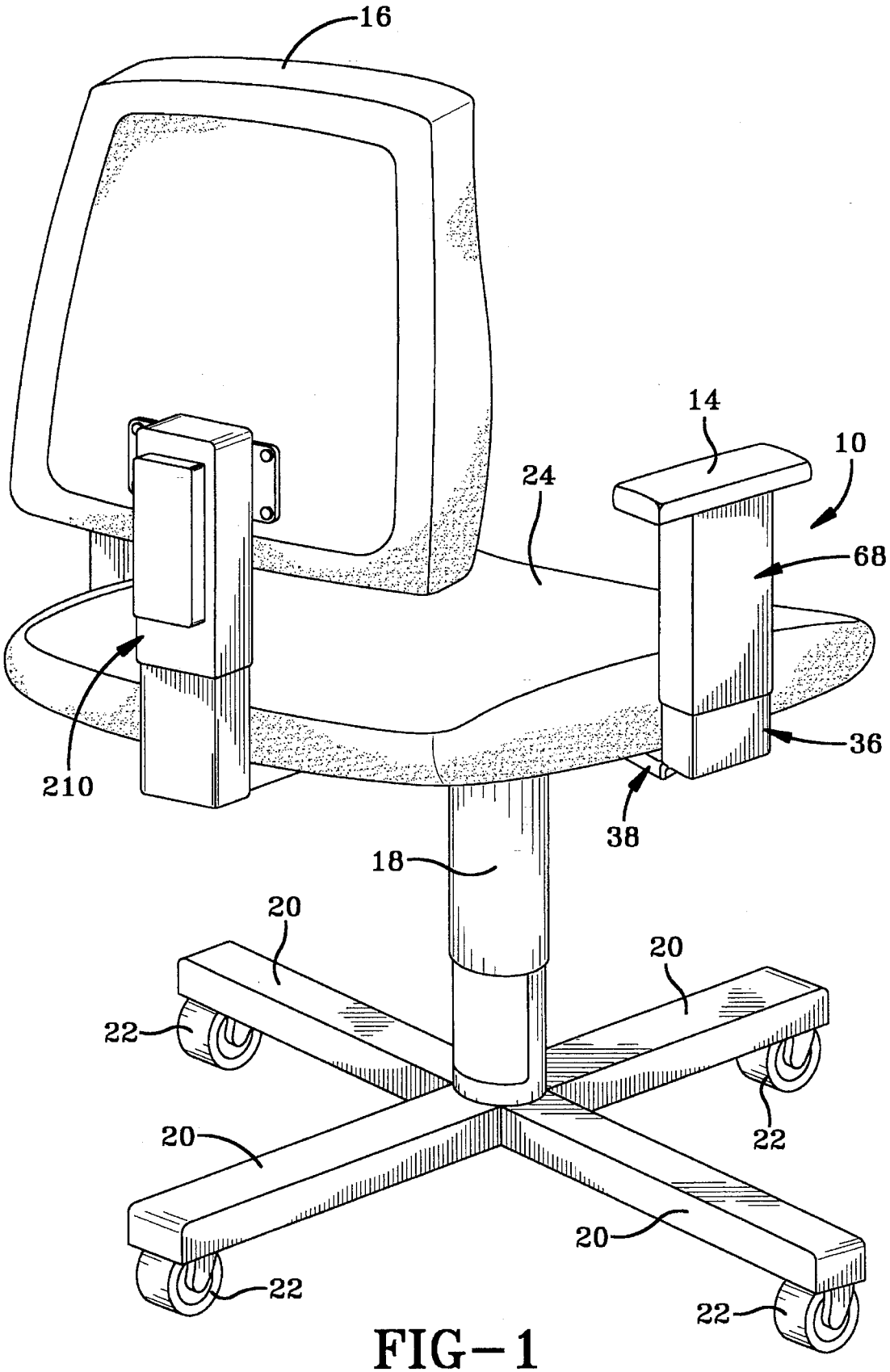
FIG. 1 is a perspective view of a chair incorporating adjusting mechanisms embodying the concepts of the present invention.

One representative form of an adjusting mechanism embodying the concepts of the present invention is designated generally by the numeral 10 on FIGS. 1 through 6, inclusive. The representative adjusting mechanism 10 is shown incorporated in a chair 12 in FIG. 1. The preferred embodiment of the adjusting mechanism 10 is shown supporting each armrest 14, and an alternative embodiment of the adjusting mechanism (including a variation thereof), designated by the numerals 210 and $\mathbf{210}_A$, respectively, and also embodying the concepts of the present invention, are shown supporting backrests 16. Each adjusting mechanism 10, 210 and $\mathbf{210}_A$ is connected either directly to an adjustable stand 18 that is supported by the radially inward portion of a plurality of radially-disposed legs 20, arranged in spider-fashion, or indirectly to the stand 18 through the seat supporting frame (not shown). A caster 22 is supported from the radially outer end portion of each leg 20. The adjustable stand 18 also supports a seat 24.

The preferred embodiment of the adjusting mechanism 10 supporting the armrests 14 may also be employed adjustably to support the backrest 16. In either event, the adjusting mechanism 10 allows a person to adjust the height of the armrests 14 and/or the backrest 16 to accommodate that person's physical characteristics. Chairs with adjustable components satisfy ergonomic considerations and thereby permit chairs to be comfortably used by many people. Inasmuch as those people who desire to adjust the chair components wish to do so without using tools, such as wrenches or screwdrivers, the present invention permits adjustment without tools. As will be more fully hereinafter described, the adjusting mechanism 10 allows a person to adjust the height of a chair component simply by lifting the component to the desired height.

To lower the component, the user first raises the component to its highest level, which serves automatically to disengage the adjusting mechanism 10. The component may then be lowered, without restraint, to its lowermost position, which serves to engage the adjusting mechanism 10. The component may then be raised, in increments, to the desired height. When in the incremental adjusting mode, the mechanism 10 allows the component to be ratchetted upwardly, but the mechanism 10 precludes the component from moving downwardly while in the adjusting mode of operation.

Figure 2:
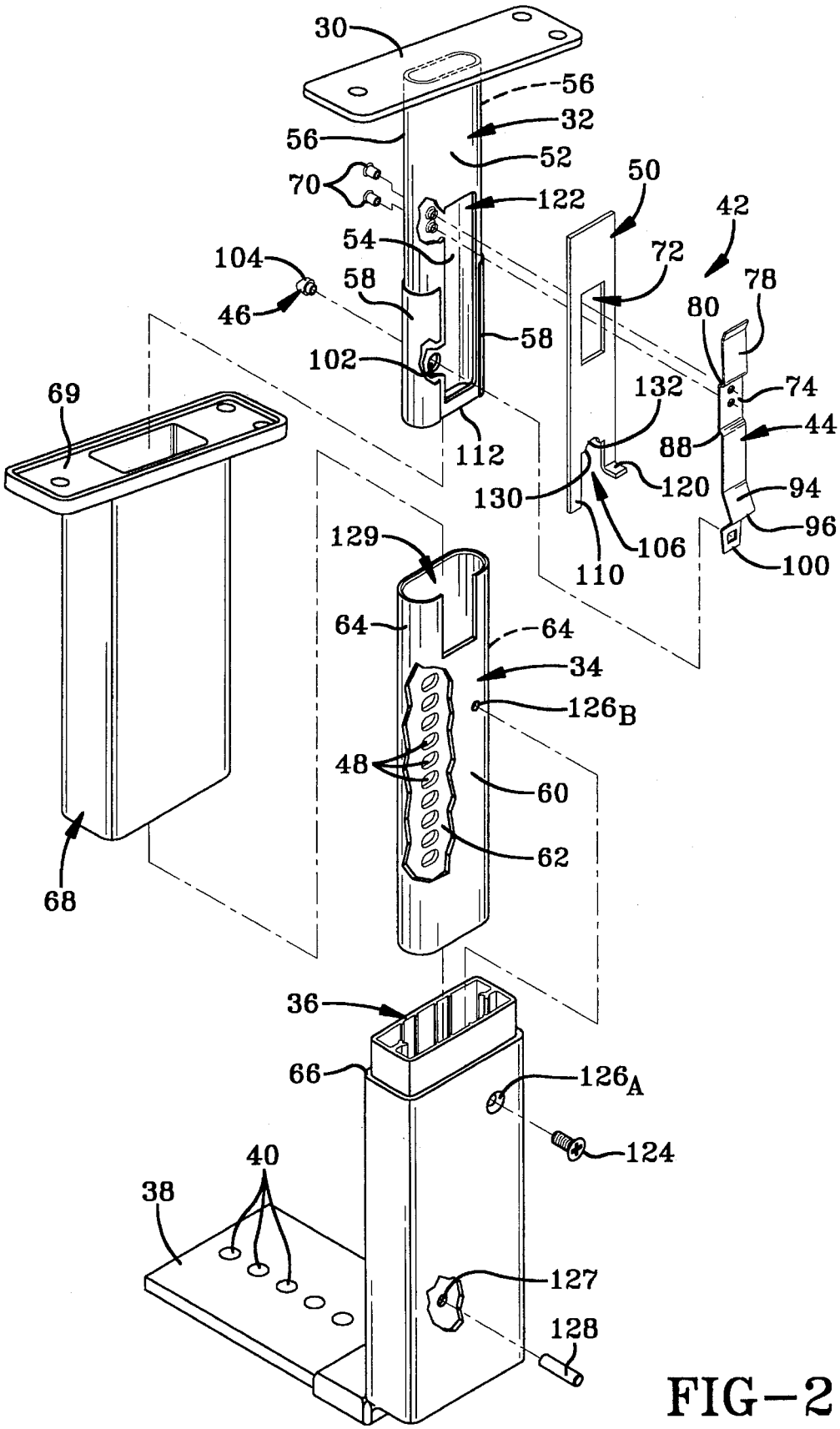
FIG. 2 is an exploded perspective of the adjusting mechanism depicted in FIG. 1 to permit selective, incremental adjustment of the armrest.

An exploded, perspective of the adjusting mechanism 10 is presented in FIG. 2. The adjusting mechanism 10, when used in conjunction with an armrest, presents an armrest attachment platform 30 that is rigidly attached to an inner tube member 32. The inner tube member 32 is slidably received within an outer tube member 34 that is secured within a containment frame 36. The containment frame 36 may be supported from the outboard end portion of a mounting arm 38 that may, in turn, be connected to the seat frame (not shown) carried on the adjustable stand 18 by a plurality of bolts (not shown) that pass through a corresponding plurality of holes 40 in the arm 38. Alternatively, the mounting arm 38 may be fastened directly to the adjustable stand 18. In either event, the inner tube member 32 and the outer tube member 34 jointly house a ratchet assembly—designated generally by the number 42—that selectively restrains the inner tube member 32 against downward translation with respect to the outer tube member 34.

The ratchet assembly 42 comprises a spring 44 fixedly secured to the inner tube member 32. The spring 44 selectively urges a ratchet dog 46—which is slidably carried by the inner tube member 32 to reciprocate axially of itself, and thus transversely of the inner tube member 32—into successive, incremental engagement with a plurality of ratchet recess means 48 disposed in spaced relation axially along at least one wall of the outer tube member 34. As shown, the ratchet recess means may even comprise a plurality of bores that penetrate one wall of the outer tube member 34.

A slider or blocking member 50 acts selectively to displace the spring 44 so that the spring 44 will either assure engagement of the dog 46 with the successive ratchet recess means 48 or preclude such engagement.

By way of a more specific description of the tube members, the inner tube member 32 may be fabricated from a rigid material such as steel. In the preferred embodiment of the present invention, the inner tube member 32 is hollow and has a cross section defined by spaced, planar, first and second walls 52 and 54 that are connected by semi-circular side walls 56. The length of the inner tube member 32 depends on the dimensional extent to which the chair components are to be adjusted. A section of felt 58 (FIG. 2) may be attached to one or more of the walls of the inner tube member 32 to provide an accommodating bushing in order to separate the relatively slidable members and at the same time accommodate modest dimensional irregularities that may be introduced during the manufacturing process as well as to ensure a smooth sliding action between the relatively slidable members and to provide a modest restriction to the sliding action between the inner tube member 32 and the outer tube member 34.

The outer tube member 34 may have a cross section that is similar to that of the inner tube member 32. As such, the outer tube member 34 may also have spaced, planar, first and second walls 60 and 62 connected by two, semi-circular side walls 64. The outer tube member 34 is dimensioned to permit the inner tube member 32 to slide inside the outer tube member 34, and the length of the outer tube member 34 will also depend on the dimensional extent to which the chair components are to be adjusted.

A plurality of axially spaced ratchet recess means 48, which may be in the nature of slots that penetrate the second wall 62 of the outer tube member 34, are provided. The axial disposition of the ratchet recess means 48 is such that the ratchet dog 46 may selectively engage each successive recess means 48 when the inner tube member 32 is slidably received in the outer tube member 34. Each recess means 48 is large enough to be engaged by the ratchet dog 46 so as to preclude relative axial movement of the inner and outer tube members 32 and 34, respectively, in at least one direction. The number, and spacing, of the recess means 48 thus depend on the overall, and incremental, range desired of the adjusting mechanism 10.

Figure 3:
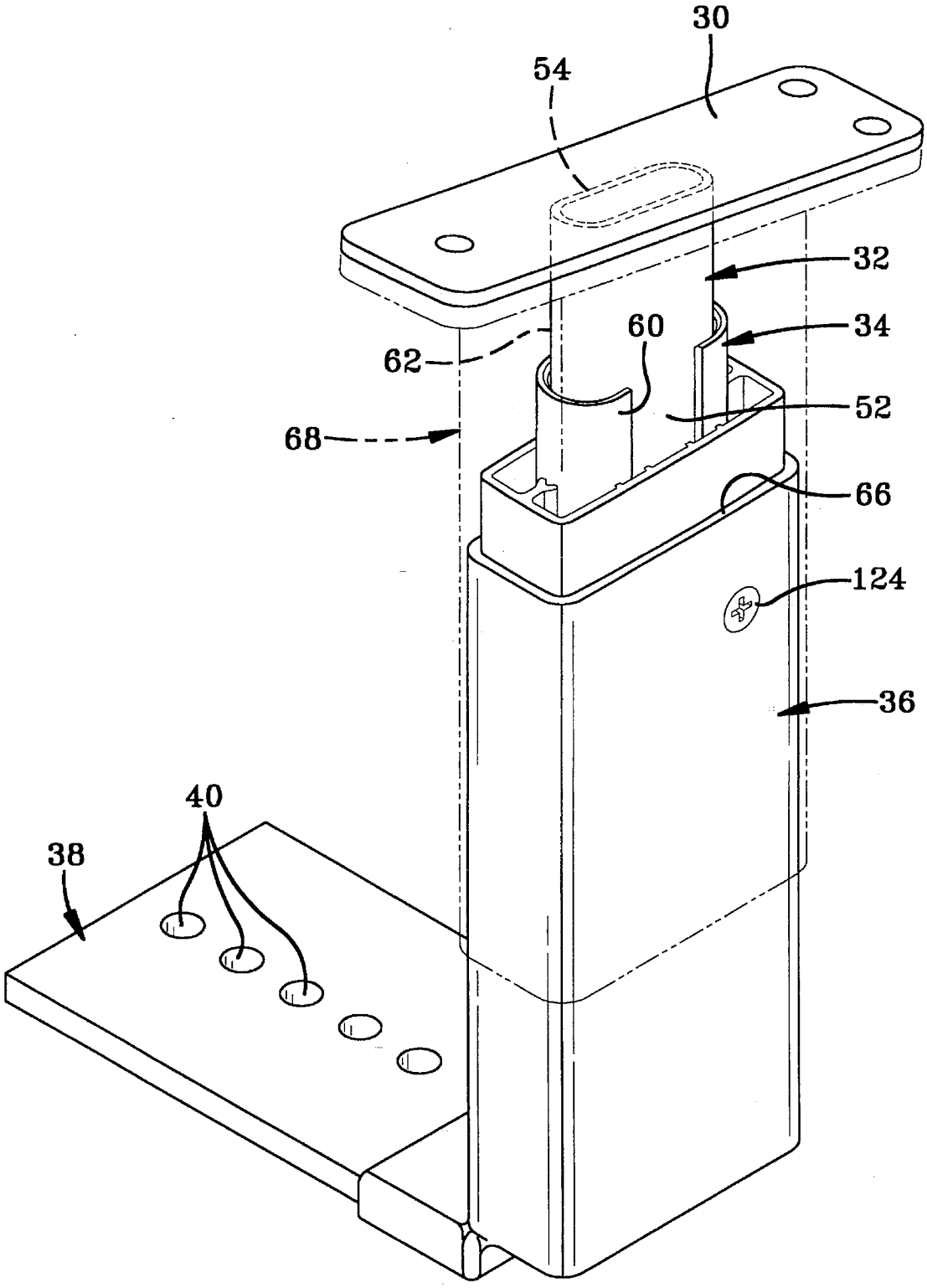
FIG. 3 is an assembled perspective of the adjusting mechanism depicted in FIG. 2.

The outer tube member 34 may be rigidly received within a containment frame 36 that may also have a rectangular cross section. The cross section of the containment frame 36 may be in any shape desired to present a pleasing outward appearance. The containment frame 36 may also be coated with a plastic or rubber material 66 that may be colored or textured to enhance the outward appearance thereof. The coating material 66 also serves as a protective bumper. When the adjusting mechanism 10 is assembled as shown in FIG. 3, a boot 68 may be positioned over the outer tube member 34, a portion of the platform 30, and partially over the containment frame 36. The boot 68 may be connected with a plurality of bolts (not shown) that pass through a mounting flange 69 that extends outwardly from the boot 68 to engage the exposed portion of the platform 30 on which the armrest 14 may be supported. The boot 68 may also be fabricated from plastic or rubber and may be colored and textured to match the coating 66 of the containment frame member 36. The boot 68 may also create a barrier between the working mechanism of the adjusting mechanism 10 and the outside environment. The boot 68 thus prevents foreign objects from entering the adjusting mechanism 10. Similarly, the boot 68 prevents lubricant from escaping the adjusting mechanism 10.

Figure 4:
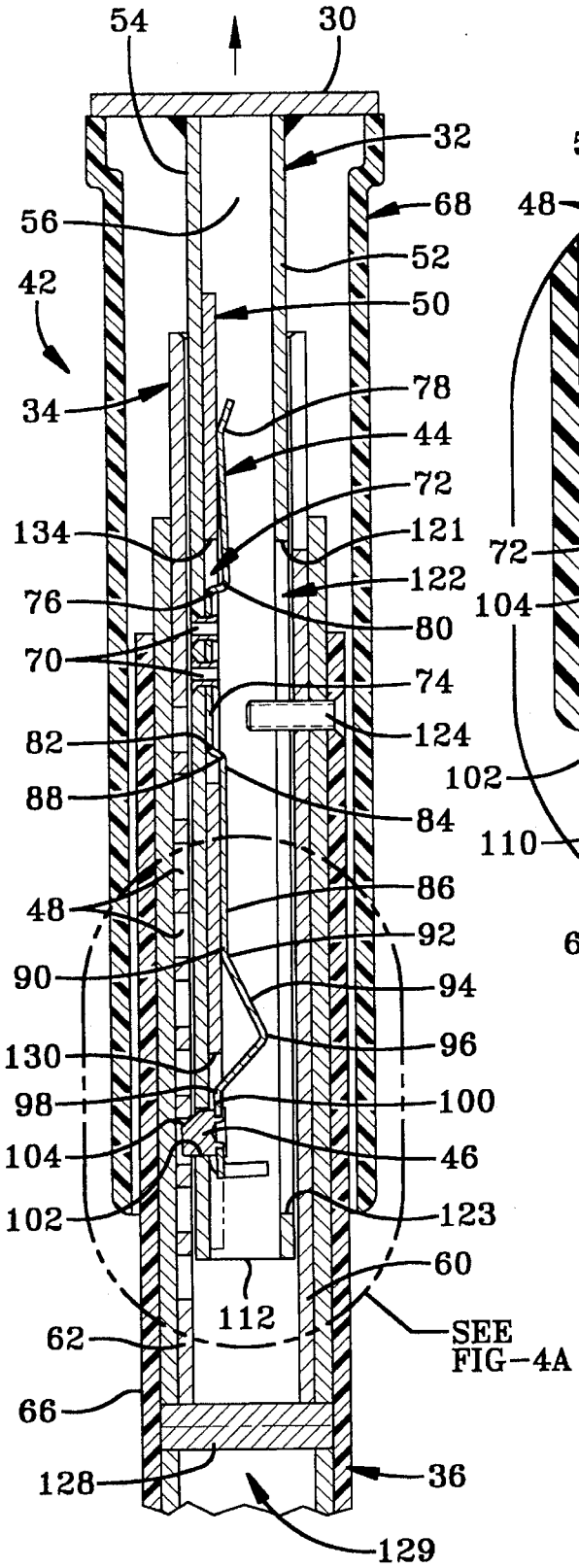
FIG. 4 is a transverse, vertical section of the adjusting mechanism depicted in FIGS. 2 and 3, the adjusting mechanism being in the adjustment mode in that the mechanism is disposed operatively to permit incremental, vertically upward adjustment of, for example, an armrest.
Figure 5:
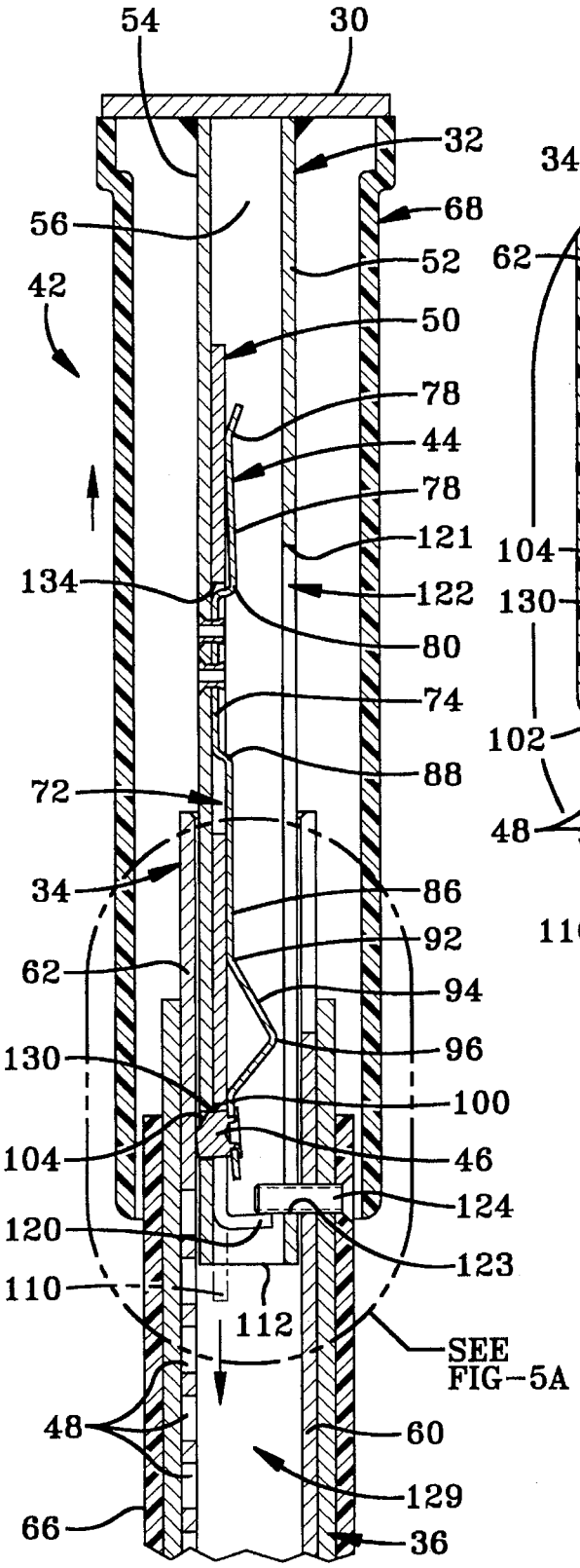
FIG. 5 is a transverse, vertical section that is similar to FIG. 4, but with the adjusting mechanism having been extended to its maximum overall extent—which is designated as the ratchet-disengaging position.
Figure 6:
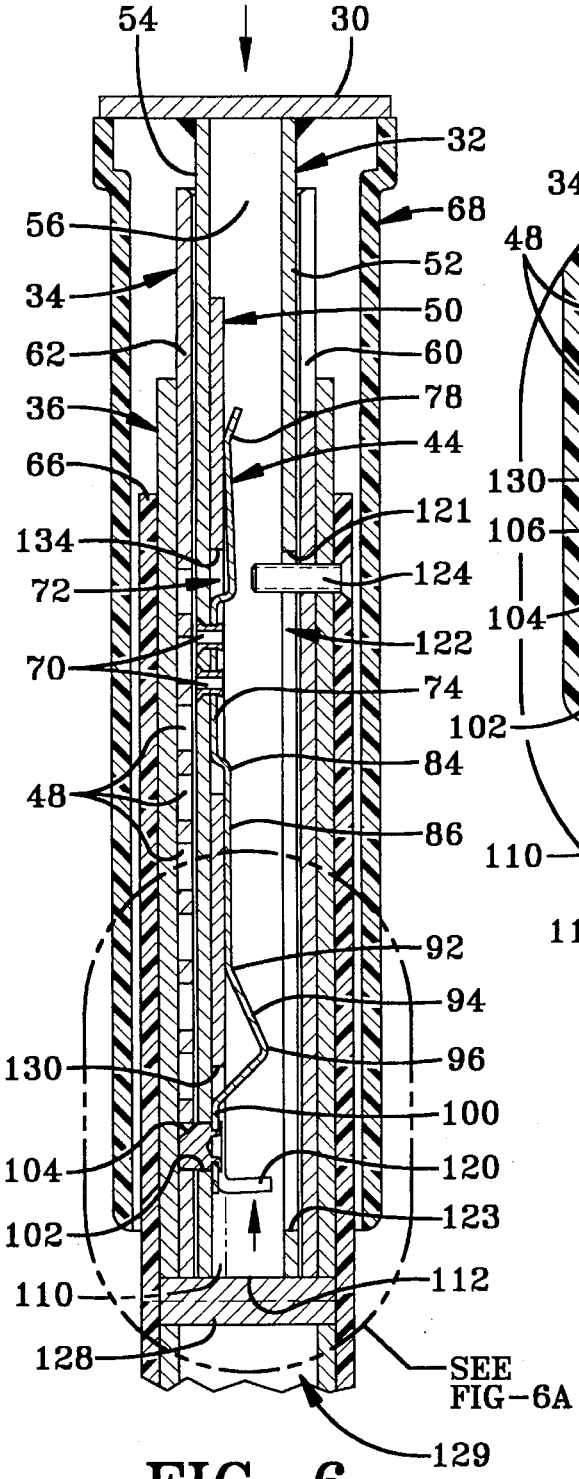
FIG. 6 is a transverse, vertical section similar to FIGS. 4 and 5, but with the adjusting mechanism having been retracted to its minimum overall extent—which is designated as the ratchet-engaging position.

As can be seen in the exploded view of FIG. 2, and in the cross-section in FIGS. 4–6, the spring 44 may be attached to the second wall 54 of the inner tube member 32, as by any suitable connecting means such as a pair of rivets 70. The slider 50 is captured between the spring 44 and the second wall 54. Specifically, the slider 50 has a mounting window 72 through which the spring 44 is secured to the second wall 54. Specifically, a foot section 74 of the spring 44 is received through the mounting window 72 to engage the second wall 54 and be secured thereto by the rivets 70. As can be perhaps best seen in FIGS. 4–6, the longitudinal dimension, or length, of the mounting window 72 in the slider 50 is greater than the corresponding length of the foot section 74 on spring 44, the reason for which will be hereinafter more fully explained. A first end 76 of the foot section 74 is connected to the top section 78 of the spring 44 by a first offset 80. The length of the first offset 80 (which defines the dimension by which the top section 78 is offset with respect to the foot section 74) is slightly greater than the thickness of the slider 50 to permit entry of the foot section through the mounting window 72 without imparting undue stress to the spring 44. The top section 78 of the spring 44, however, preferably contacts the slider 50 and urges the slider 50 against the second wall 54 of the inner tube member 32. Contact with the top section 78 of the spring 44 prevents the slider 50 from rattling, or shaking, when the chair 12 moves.

Similarly, the second end 82 of the foot section 74 is connected to the first end 84 on the middle section 86 of the spring 44 by a second offset 88. The length of the second offset 88 (which defines the dimension by which the middle section 86 is offset with respect to the foot section 74) is also slightly greater than the thickness of the slider 50 additionally to facilitate entry of the foot section 74 through the mounting window 72 without imparting undue stress to the spring 44 and also to permit the middle section 86 of the spring 44 to press against the slider 50. The second end 90 of the middle section 86 of the spring 44 is connected to the first end 92 of a raised section 94 of the spring 44. As can be seen in FIGS. 4–6, the raised section 94 of the spring reverses its direction of inclination at an apex 96. The second end 98 on the raised section 94 of the spring 44 is connected to a bottom section 100 of the spring 44 that is approximately parallel to the middle section 86, the foot section 74 and the top section 78 of the spring 44.

The ratchet dog 46 is rigidly connected, as by being swaged, to the bottom section 100 of the spring 44 such that the ratchet dog 46 extends through the second wall 54 of the inner tube member 32. In its quiescent state the bottom section 100 of the spring 44 rests against the second wall 54 of the inner tube member 32. The second wall 54 has an aperture 102 that allows the dog 46 to pass through the second wall 54 of the inner tube member 32 and engage the ratchet recess means 48 in the second wall 62 of the outer tube member 34. The ratchet dog 46 has a beveled edge 104 that serves as a cam follower which permits the ratchet dog 46 slidably to engage the upper portion of the ratchet recess means 48 in response to incremental upward movement of the armrest 14, as represented in FIG. 4, and thereby force disengagement of the ratchet dog 46 from the successive ratchet recess means 48 in response to upwardly directed translation of the inner tube member 32 within the outer tube member 34. This interaction permits the armrest 14 to be incrementally raised, ratchet recess by ratchet recess.

As noted, the slider 50 is slidably disposed between the second wall 54 of the inner tube member 32 and the spring 44. As was also previously described, the slider 50 has an mounting window 72 that allows the foot section 74 of the spring 44 to contact the second wall 54. Below the mounting window 72, the slider 50 has a U-shaped recess 106 (FIG. 2) that allows the ratchet dog 46 to pass therethrough to access the second wall 54 of the inner tube member 32. The recess 106 is wider than the bottom section 100 of the spring 44. Thus, when the spring 44 is mounted on the inner tube member 32, as shown in FIG. 6, the bottom section 100 is disposed within the recess 106 of the slider 50 to engage the second wall 54 of the inner tube member 32.

On one side of the recess 106, a prong 110 extends downwardly from the slider 50. The prong 110 extends beyond the lower edge 112 of the inner tube member 32 as shown in FIG. 5. However, when the slider 50 translates to the position shown in FIGS. 4 and 6, the prong 110 is disposed entirely within the inner tube member 32.

On the other side of the recess 106, a hook 120 extends downwardly and outwardly from the slider 50. As will be hereinafter more fully described, the prong 110 and the hook 120 cause the slider 50 to translate with respect to the inner tube member 32 and react with the spring 44 to select the operational modes of the adjusting mechanism 10.

A longitudinally extending slot 122 is provided in the first wall 52 of the inner tube member 32 to serve as a slide-way within which a stop screw 124 may be translated. As such, the slot 122 not only allows the hook 120 to engage the stop screw 124 that extends inwardly from the first wall 60 of the outer tube member 34 but the slot 122 also has an upper end 121 that provides clearance for unrestricted movement of the stop screw 124 in one direction, and a lower end 123 that serves as a delimiter which restricts movement of the stop screw 124 in the other direction, as will be hereinafter more fully explained. In fact, the stopping action may be effected by the inner end portion of the stop screw 124 by which the containment frame 36 may be attached to the outer tube member 34. As such, the containment frame 36 and the first wall 60 of the outer tube member 34 are provided with bores $\mathbf{126}_A$ and $\mathbf{126}_B$, respectively, for accepting the stop screw 124 therethrough, as shown on FIG. 2. The bores $\mathbf{126}_A$ and $\mathbf{126}_B$ may be threaded, or the stop screw 124 may be self-threading, as dictated by manufacturing costs. When the inner tube member 32 is translated upwardly with respect to the outer tube member 36 a sufficient distance to approach the ratchet-disengaging position, the hook 120 engages the stop screw 124 and the slider 50 is translated downwardly with respect to the inner tube member 32 to the dog-blocking position. When this occurs, the inner tube member 32, and thus the chair component, has reached the uppermost, or ratchet-disengaging, position.

A stop bar 128 (FIGS. 2 and 6) is received within appropriate bores 127 in the walls 60 and 62 of the outer tube member 34 and extends substantially perpendicularly across the central passage 129 through the outer tube member 34. The stop bar 128 is positioned such that it will be contacted by the prong 110 of the slider 50 when the inner tube member 32 is translated downwardly with respect to the outer tube member 34. The stop bar 128, therefore, delineates the lowermost point that the inner tube member 32 may translate with respect to the outer tube member 34. In order to permit the desired range of downward translation for the inner tube member 32, the upper, or clearance, end 121 of the slot 122 must be suitably located so as to preclude engagement with the stop screw 124 before the inner tube member 32 reaches the lowermost point in its translational movement.

When the prong 110 contacts the stop bar 128, the slider 50 is translated upwardly with respect to the inner tube member 32. The bottom end 112 of the inner tube member 32 then contacts the stop bar 128 and further translation of the inner tube member 32 is then stopped at what is designated as the ratchet-engaging position.

Between the prong 110 and the hook 120 the recess 106 terminates in a blocking edge, blocking portion or wedge, 130. The medial portion of the blocking edge 130 presents a semi-circular concavity 132 which is preferably of substantially the same diameter as that portion of the ratchet dog 46 which is received for reciprocating translation within the hole 102 in the second wall 54 of the inner tube member 32. The concavity 132 is longitudinally aligned with the ratchet dog 46 so that when the slider 50 is in the dog-blocking position the concavity 132 will be able to embrace the ratchet dog 46, the reason for which will be hereinafter fully explained in conjunction with the operational description of the adjusting mechanism 10.

OPERATION OF THE PREFERRED EMBODIMENT OF THE PRESENT INVENTION

Operation of the adjusting mechanism may be readily comprehended by reference to an exemplary installation utilized to adjust an armrest 14. With reference first to FIG. 4, which depicts the incremental adjusting mode, it will be observed that the height of the armrest 14 (as represented by the attachment platform 30) may be readily adjusted simply by lifting the armrest 14 to the desired vertical position. In the incremental adjusting mode the inner tube member 32 is precluded from downward translation by virtue of the ratchet dog 46 which extends through the hole 102 in the second wall 54 of the inner tube member 32 to engage one of the ratchet recess means 48 in the second wall 62 of the outer tube member 34. The ratchet dog 46 thus serves as a shear member which forecloses downward translation of the inner tube member 32 with respect to the outer tube member 34. As such, the armrest 14 is secured against downward movement.

Figure 4A:
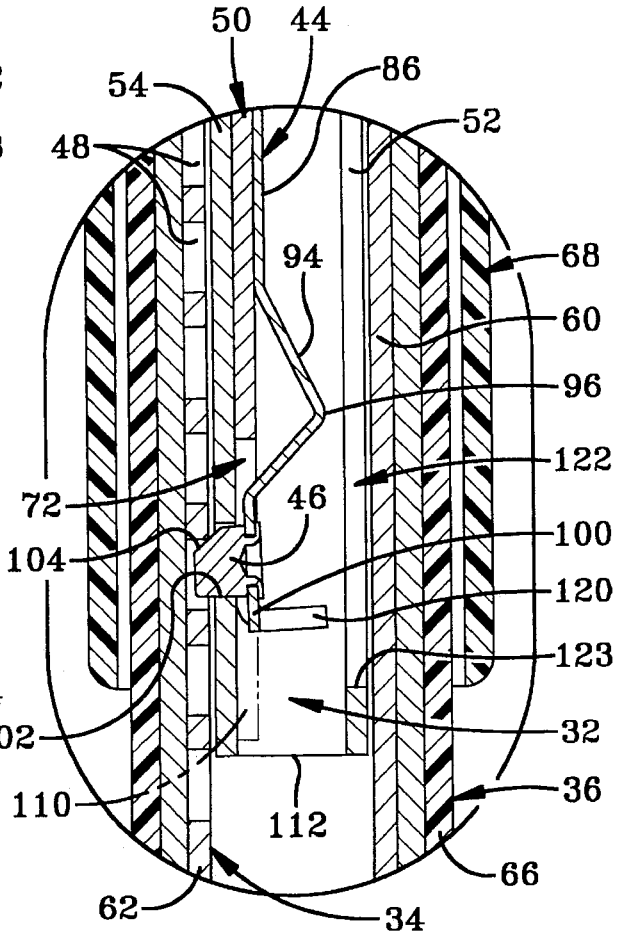
FIG. 4A is an enlarged area of that portion of FIG. 4 delineated by the rectangular chain line designated "SEE FIG-4A" on FIG. 4.
Figure 5A:
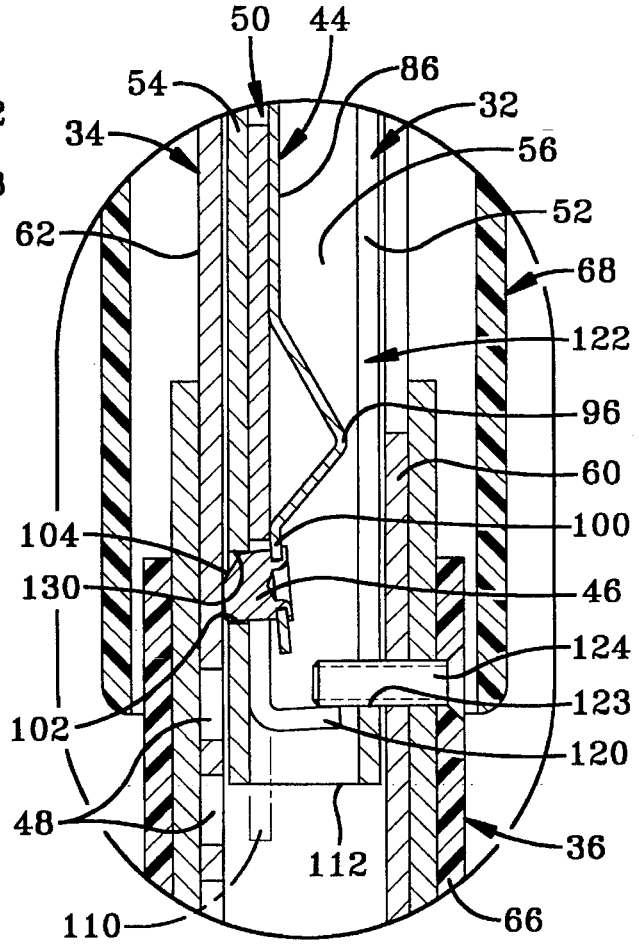
FIG. 5A is an enlarged area of that portion of FIG. 5 delineated by the rectangular chain line designated "SEE FIG-5A" on FIG. 5.

In the incremental adjusting mode the slider 50 is in its upper, or dog-release, position, and to increase the height of the armrest 14 one simply lifts the armrest 14. Lifting the armrest 14 when the adjusting mechanism 10 is in the incremental adjusting mode causes the inner tube member 32 to move upwardly with respect to the outer tube member 34. This upward translation is achieved because the beveled edge 104 on the upper side of the ratchet dog 46 acts as a cam follower when it engages the ratchet recess means 48 while moving upwardly, as best shown in FIG. 4A, thus driving the ratchet dog 46 out of the ratchet recess means 48 (FIG. 5A) against the biasing action applied to the ratchet dog 46 by the bottom portion 100 of the spring 44. When the ratchet dog 46, which remains slidably received within the hole 102, aligns with the next upwardly successive ratchet recess means 48, the biasing action of the spring 44 urges the ratchet dog 46 into engagement with the next successively aligned recess means 48. The armrest 14 is then once again locked against downward translation. That process may be repeated until the armrest 14 is located at the desired height.

It should be understood, however, that at each incremental height the ratchet dog 46 acts as a shear pin which precludes downward translation of the armrest 14.

To lower the armrest 14, the armrest 14 must first be raised to its uppermost, or ratchet-disengaging, position, as shown in FIG. 5 in which the inner tube member 32 and the outer tube member 34 may be described as being positioned in an extended alignment with respect to each other. As the armrest 14 approaches its uppermost, or ratchet-disengaging, position, the hook 120 engages the stop screw 124. As the armrest 14 continues to be urged upwardly, engagement of the hook 120 with the stop screw 124 translates the slider 50 downwardly with respect to the inner tube member 32 until the stop screw 124 engages the lower, or delimiting, end 123 of the slot 122, thereby precluding further downward translation of the slider 50. When this occurs: the armrest 14 can no longer be raised; the inner tube member 32 is in its ratchet-disengaging position; and, the slider 50 is in the dog-blocking position.

The downward translation of the slider 50 effected by engagement of the hook 120 with the stop screw 124 causes the blocking edge 130 in the U-shaped recess 106 of the slider 50 to wedge itself under the bottom section 100 of the spring 44, thus lifting the ratchet dog 46 out of engagement with the ratchet recess means 48 in the second wall 62 of the outer tube member 34. In this situation the slider 50 is in its dog-blocking position, and the armrest 14 may now be lowered because the dog 46 can not engage any of the ratchet recess means 48 in the second wall 62 of the outer tube member 34. The bottom section 100 of the spring 44 remains deflected while the inner tube member 32 is lowered within the outer tube member 34 because the blocking edge 130 of the slider 50 remains wedged under the bottom section 100 of the spring 44. In order to assure the desired penetration of the blocking edge 130 beneath the bottom portion 100 of the spring 44, the semi-circular concavity 132 in the blocking edge will preferably embrace the ratchet dog 46.

The armrest 14 does not fall freely because of the felt 58 that is interposed between the inner and outer tube members 32 and 34, respectively.

Figure 6A:
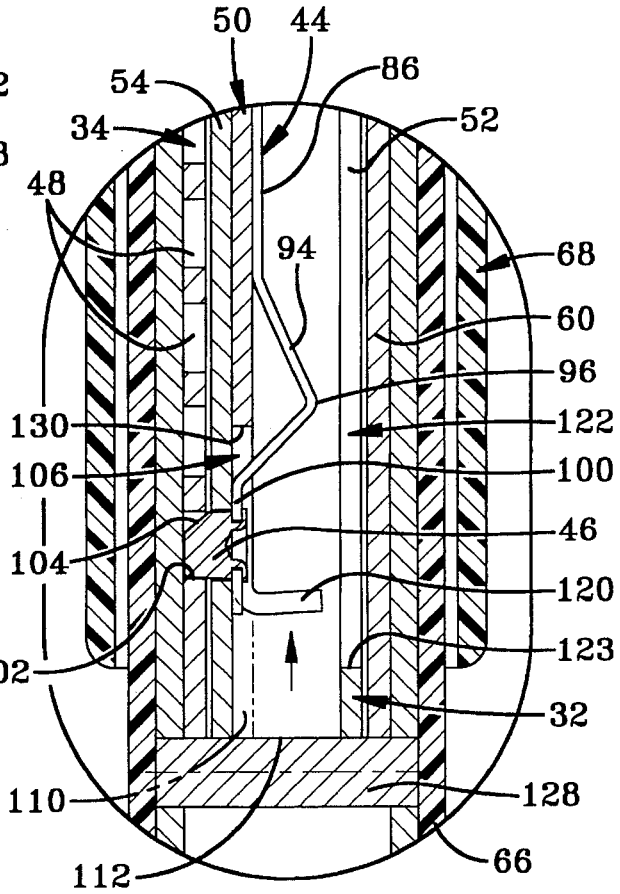
FIG. 6A is an enlarged area of that portion of FIG. 6 delineated by the rectangular chain line designated "SEE FIG-6A" on FIG. 6.

When the armrest 14 approaches its lowermost position, the prong 110 engages the stop bar 128 such that continued downward movement of the armrest 14 forces the slider 50 to translate upwardly with respect to the inner tube member 32 to the dog-release position of the slider 50, as represented in FIGS. 6 and 6A. When the armrest 14 is positioned in its lowermost position, the inner tube member 32 and the outer tube member 34 may be described as being positioned in a retracted alignment with respect to each other. As the slider 50 translates upwardly, the blocking edge 130 thereon is removed from between the bottom section 100 of the spring 44 and the slider 50, permitting the spring 44 to bias the ratchet dog 46 once again into engagement with one of the ratchet recess means 48 provided in the second wall 62 of the outer tube member 34. The slider 50 is now in its upper, dog-release, position, and the inner tube member 32 is in its ratchet-engaging position, as represented in FIGS. 4 and 4A. Thus, when the armrest 14 is raised, the ratchet dog 46 will once again engage the successive recess means 48, and the armrest 14 will be restrained against downward movement, but the user of the chair may then lift the armrest 14 to the desired height.

A SECOND ALTERNATIVE EMBODIMENT OF THE PRESENT INVENTION

Figure 12:
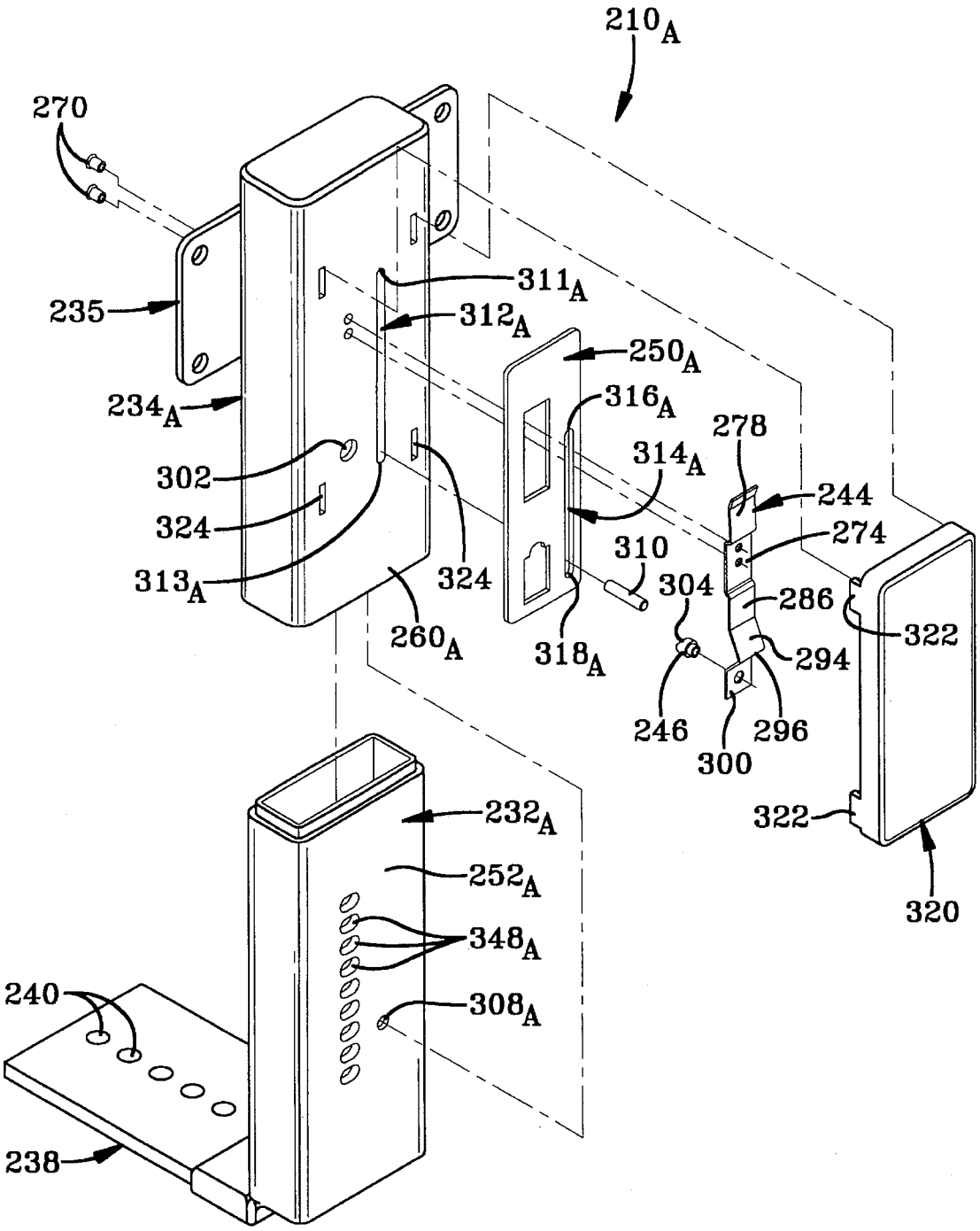

A second alternative embodiment of the present invention is designated by the numeral 210 in FIGS. 7 through 11, inclusive, with a variation of the second embodiment being depicted in FIG. 12 and designated by the numeral $\mathbf{210}_A$. Structural elements that are common to the alternative embodiment 210 and the variation $\mathbf{210}_A$ of the alternative embodiment will bear common numerical designators, but structural elements that are different will bear the same number, but with an "$_A$" subscript.

Figure 7:
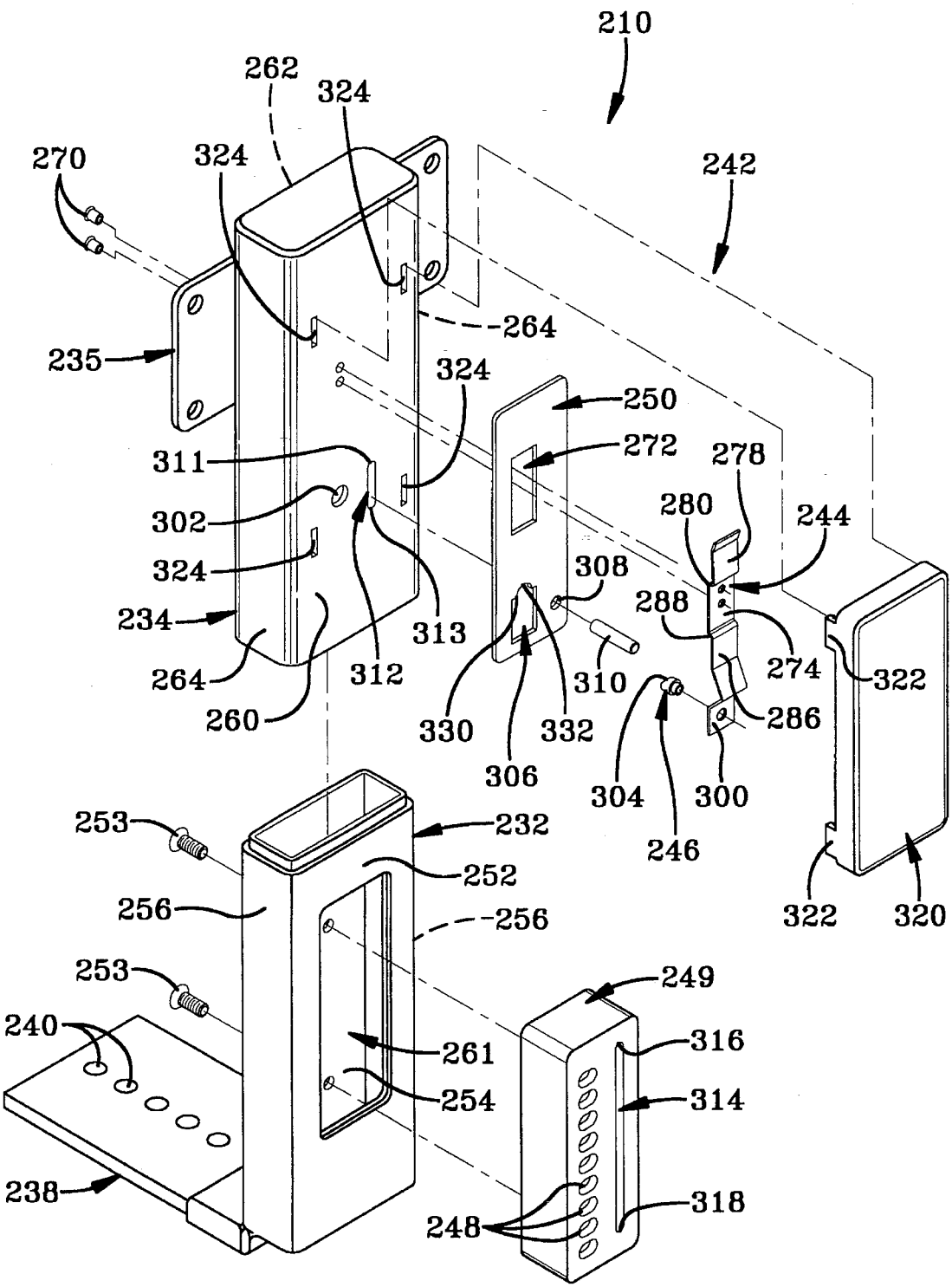
FIG. 7 is an exploded perspective view of an alternative embodiment of an adjusting mechanism embodying the concepts of the present invention.
Figure 8:
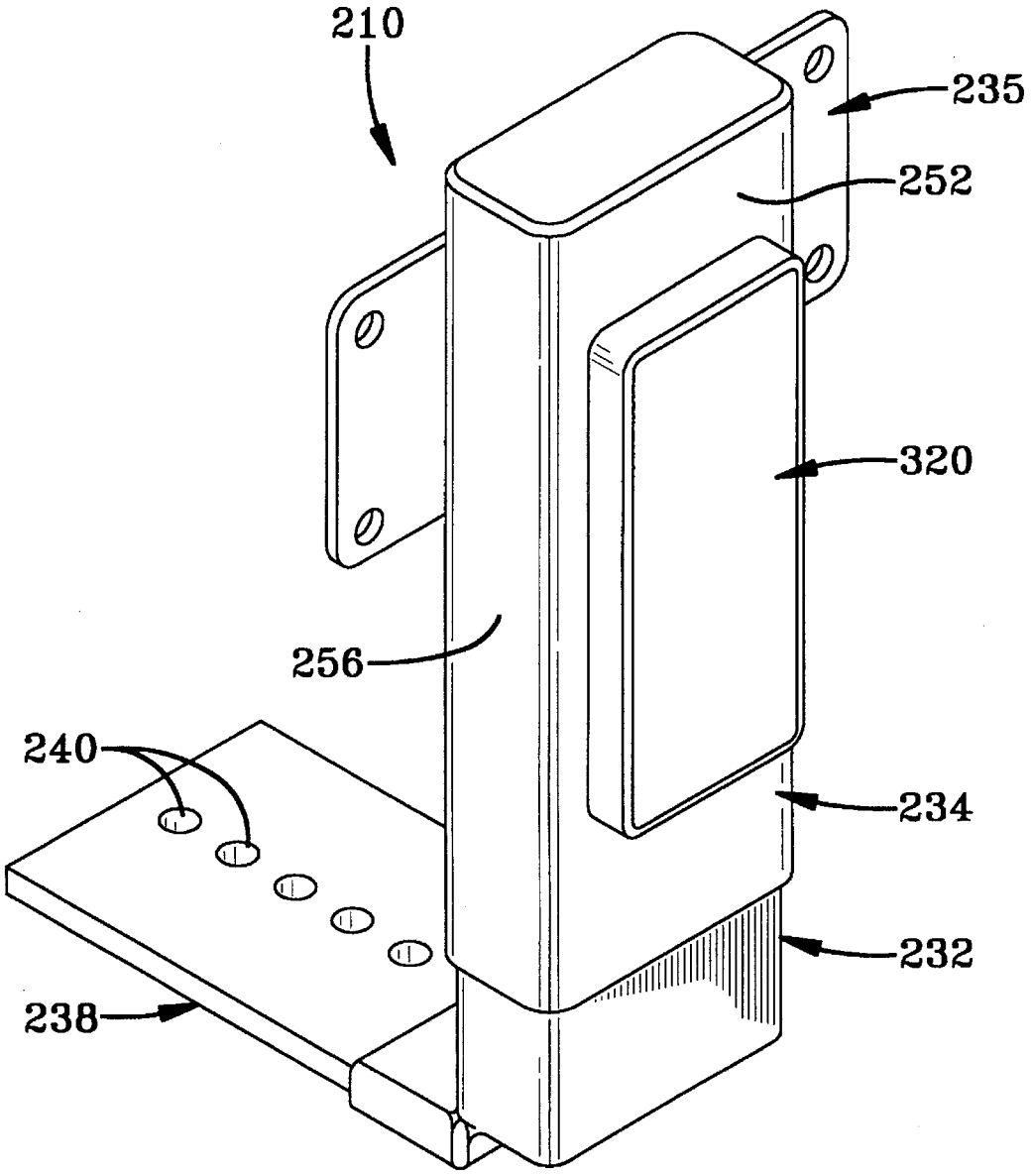
FIG. 8 is similar to FIG. 3 in that it comprises an assembled perspective of the alternative adjusting mechanism depicted in FIG. 7.

With particular reference, then, to the exploded perspective depicted in FIG. 7, the adjusting mechanism 210 utilizes an outer tube member 234 which presents an attaching flange 235 that may be secured to an adjustable component such as a backrest 16 (FIG. 1). A fixed inner tube member 232 is received within the outer tube member 234, and the outer tube member 234 is coaxially slidable along the inner tube member 232. The inner tube member 232 is fixed in that it may be supported from the outboard end portion of a mounting arm 238 that may, in turn, be connected to the seat frame (not shown) carried on the adjustable stand 18 by a plurality of bolts (not shown) that pass through a corresponding plurality of holes 240 in the arm 238. Alternatively, the mounting arm 238 may be fastened directly to the adjustable stand 18. In either event, the inner tube member 232 and the outer tube member 234 house a ratchet assembly—designated generally by the number 242—that selectively restrains the outer tube member 234 against downward translation with respect to the inner tube member 232.

The ratchet assembly 242 comprises a spring 244 fixedly secured to the outer tube member 234. The spring 244 selectively urges a ratchet dog 246—which is carried by the outer tube member 234 to reciprocate axially of itself, and thus transversely of the outer tube member 234—into successive, incremental engagement with a plurality of ratchet recess means 248 disposed in spaced relation axially along an insert 249 that is connected to the inner tube member 232. The ratchet recess means $\mathbf{248}_A$ may, on the other hand, be directly formed in at least one wall $252_A$ of the inner tube member $232_A$, as shown in FIG. 12. Thus, the ratchet recess means may comprise a plurality of bores that penetrate either the insert 249 or one wall $252_A$ of the inner tube member $232_A$.

A slider 250 (or $250_A$) acts selectively to displace the spring 244 so that the spring 244 will either assure engagement of the ratchet dog 246 with the successive ratchet recess means 248 (or $248_A$) or preclude such engagement.

By way of a more specific description of the tube members, the inner tube member 232 may be fabricated from a rigid material such as steel. In the alternative form of the present invention, the inner tube member 232 may also be hollow, but it may have a rectangular cross section defined by spaced, planar, first and second walls 252 and 254 that are connected by planar side walls 256.

The outer tube member 234 may have a cross section that is similar to that of the inner tube member 232. As such, the outer tube member 234 may also have spaced, planar, first and second walls 260 and 262 connected by two, planar side walls 264. The tube members 232 and 234 are dimensioned to permit the outer tube member 234 to slide outside the inner tube member 232, and the length of the tube members 232 and 234 will depend on the dimensional extent to which the chair components are to be adjusted.

The plurality of axially spaced ratchet recess means, which may be in the nature of slots 248, penetrate the insert 249 (FIG. 7), as stated previously herein, or the recess means $248_A$ may be provided in the first wall $252_A$ of the inner tube member $232_A$. When an insert 249 is used, the insert 249 may be received with an enlarged aperture 261 that penetrates the first wall 252 of the inner tube member 232. The insert 249 may be secured in position by a plurality of machine screws 253 that extend through the second wall 254 of the inner tube member 232. An insert 249 may be used to allow the ratchet recess means 248 to be replaced when they wear, or to provide a harder material within which to provide the ratchet recess means 248, should the first wall 252 of the inner wall member 232 be made of softer material than required to withstand the wear of constant usage. But irrespective of whether the recess means 248 are provided in an insert 249 or whether the recess means $248_A$ are provided directly in the first wall $252_A$ of the inner tube member $232_A$, the longitudinally spaced recess means 248 (or $248_A$) are disposed such that the ratchet dog 246 will engage each successive recess means 248 (or $248_A$) when the outer tube member 234 is slidably received over the inner tube member 232 (or $232_A$). The recess means, irrespective of how they are provided, must be large enough to be engaged by the ratchet dog 246 so as to preclude relative axial movement of the inner and outer tube members in at least one direction. The number, and spacing, of the recess means 248 (or $248_A$) thus depends on the overall, and incremental, range desired for the adjusting mechanism 210 (or $210_A$).

Figures 9, 10, 11:
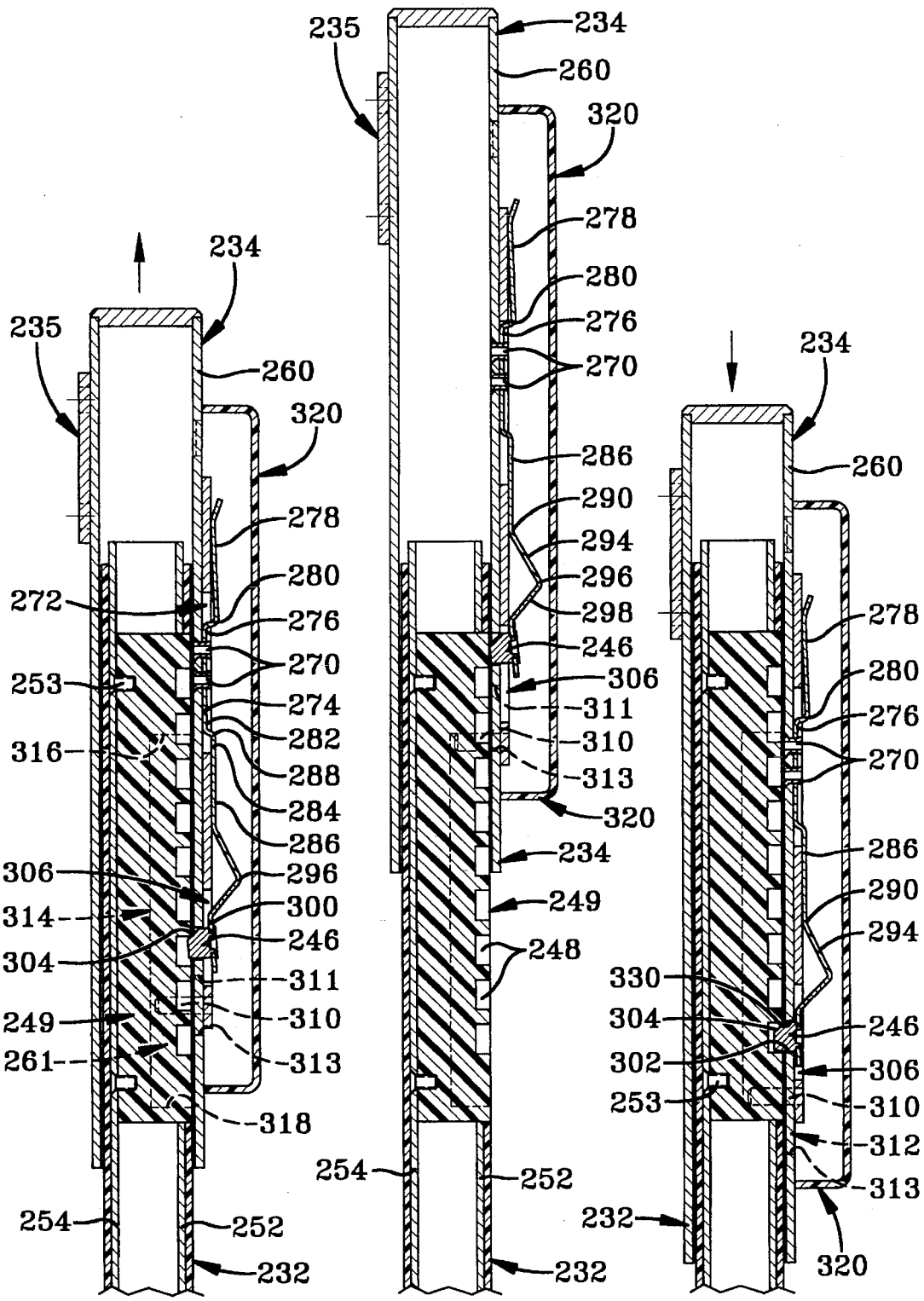
FIG. 9 is a transverse, vertical section of the adjusting mechanism depicted in FIG. 8, the adjusting mechanism being in the adjustment mode in that the mechanism is disposed operatively to permit incremental, vertically upward adjustment of the backrest.
FIG. 10 is a transverse, vertical section similar to FIG. 9, but with the adjusting mechanism having been extended to its maximum overall extent—which is designated as the ratchet-disengaging position.
FIG. 11 is a transverse, vertical section similar to FIGS. 9 and 10, but with the adjusting mechanism having been retracted to its minimum overall extent—which is designated as the ratchet-engaging position; and, FIG. 12 is an exploded perspective view of a variation of the alternative embodiment of the adjusting mechanism depicted in FIGS. 7–11.

As can be seen in the exploded view of FIG. 7, and in cross-section in FIGS. 9–11, the spring 244 comprises a plurality of connected sections and may be the same configuration as spring 44 previously described for the preferred embodiment of the present invention, although the spring is connected to a different tube member in the alternative embodiment. Specifically, the spring 244 may be attached to the first wall 260 of the outer tube member 234, as by any suitable connecting means such as a pair of rivets 270. The slider 250 is captured between the spring 244 and the first wall 260. Specifically, the slider 250 has a mounting window 272 through which the spring 244 is secured to the first wall 260. Specifically, a foot section 274 of the spring 244 is received through the mounting window 272 to engage the first wall 260 and be secured thereto by the rivets 270. As can be perhaps best seen in FIGS. 9–11, the longitudinal dimension, or length, of the mounting window 272 in the slider 250 is greater than the corresponding length of the foot section 274 on the spring 244, the reason for which will be hereinafter more fully explained.

A first end 276 of the foot section 274 is connected to the top section 278 of spring 244 by a first offset 280. The length of the first offset 280 (which defines the dimension by which the top section 278 is offset with respect to the foot section 274) is slightly greater than the thickness of the slider 250 to permit entry of the foot section 274 through the mounting window 272 without imparting undue stress to the spring 244. The top section 278 of the spring 244, however, preferably contacts the slider 250 and urges the slider 250 against the first wall 260 of the outer tube member 234. Contact with the top section 278 of the spring 244 prevents the slider 250 from rattling, or shaking, when the chair 12 moves.

Similarly, the second end 282 of the foot section 274 is connected to the first end 284 on the middle section 286 of the spring 244 by a second offset 288. The length of the second offset 288 (which defines the dimension by which the middle section 78 is offset with respect to the foot section 74) is also slightly greater than the thickness of the slider 250 additionally to facilitate entry of the foot section 274 through the mounting window 272 without imparting undue stress to the spring 244 and also to permit the middle section 286 of the spring 244 to rest against the slider 250. The second end 290 on the middle section 286 of the spring 244 is connected to the first end 292 of a raised section 294 of the spring 244. As can be seen in FIGS. 9–11, the raised section 294 of the spring 244 reverses its direction of inclination at an apex 296. The second end 298 on the raised section 294 of the spring 244 is connected to a bottom section 300 of the spring 244 that is approximately parallel to the middle section 286, the foot section 274 and the top section 278 of the spring 244.

The ratchet dog 246 is rigidly connected, as by being swaged, to the bottom section 300 of the spring 244 such that the ratchet dog 246 extends through the first wall 260 of the outer tube member 234. In its quiescent state the bottom section 300 of the spring 244 rests against the first wall 260 of the outer tube member 234. The first wall 260 has an aperture 302 that allows the dog 246 to pass through the first wall 260 of the outer tube member 234 and engage the ratchet recess means 248 presented from the inner tube member 232, irrespective of whether the ratchet recess means are provided in an insert 249 or in the first wall $252_A$ of the inner tube member $232_A$.

The ratchet dog 246 has a beveled edge 304 that serves as a cam follower which permits the ratchet dog 246 to engage the sides of the ratchet recess means 248 (or $248_A$) in response to incremental upward movement of the backrest 16, as represented by the attaching flange 235 on FIGS. 7–12, and thereby force disengagement of the ratchet dog 246 from the successive ratchet recess means 248 (or $248_A$) in response to upwardly directed translation of the upper tube member 234 exteriorly of the inner tube member 232. This interaction permits the backrest 16 to be incrementally raised, ratchet recess by ratchet recess.

The slider 250 is slidably disposed between the first wall 260 of the outer tube member 234 and the spring 244. As previously described, the slider 250 has a mounting window 272 that allows the foot section 274 of the spring 244 to contact the first wall 260. Below the mounting window 272, the slider 250 has a second window 306 (FIG. 7) that allows the ratchet dog 246 to pass therethrough to access both the first wall 260 of the outer tube member 234 and the ratchet recess means 248. The second window 306 is wider than the bottom section 300 of the spring 244. Thus, when the spring 244 is relaxed, as shown in FIG. 11, the bottom section 300 is disposed within the second window 306 of the slider 250 to engage the first wall 260 of the outer tube member 234. The upper extent of the second window terminates in a blocking edge, or wedge, 330. The medial portion of the blocking edge 330 presents a semi-circular concavity 332 which is preferably of substantially the same diameter as that portion of the ratchet dog 246 which is received for reciprocating translation within the hole 302 in the first wall 260 of the outer tube member 234. The concavity 332 is longitudinally aligned with the ratchet dog 246 so that when the slider 250 is in the dog-blocking position the concavity 332 will be able to embrace the ratchet dog 246, for the same reason as explained in the description of the preferred embodiment.

In the embodiments depicted in FIGS. 7–11, the slider 250 also has a locating hole 308 for accepting a trigger pin 310. When the adjusting mechanism 210 is assembled, the trigger pin 310 is tightly received in the locating hole 308 and extends through a first, or slotted access, aperture 312 in the outer tube member 234. The slotted access aperture 312 has an upper, or first delimiting, end 311 and a lower, or second, delimiting end 313. The slotted access aperture 312 is parallel to the longitudinal axis of the outer tube member 234 and is long enough to allow the trigger pin 310 to translate freely therealong when relative movement is required between the trigger pin 310 and the slotted access aperture 312. It should be understood that for the most part the trigger pin 310 and the slotted access aperture 312 are simultaneously translated. However, as the trigger pin 310 engages the ends of the slotted reaction aperture 314, as will be hereinafter more fully explained, some relative translational movement between the trigger pin 310 and the slotted access aperture 312 is required. The trigger pin 310 further extends into a second, or slotted reaction, aperture 314 in the insert 249. One end 316 of the slotted reaction aperture 314 defines the ratchet-disengaging position, and the other end 318 of the slotted reaction aperture 314 defines the ratchet-engaging position.

In the variation of the second embodiment, as shown in FIG. 12, the locating hole $308_A$ is provided in the first wall $252_A$ of the inner tube member $232_A$. The first, or slotted access aperture $312_A$ is located in the first wall $260_A$ of the outer tube member 234. The access aperture $312_A$ is parallel to the longitudinal axis of the outer tube member $234_A$ and is long enough to allow the trigger pin 310 to translate freely therealong when relative movement is required between the trigger pin 310 and the slotted access aperture $312_A$. Unlike the embodiment depicted in FIGS. 7–11, the slotted access aperture $312_A$ will be required to accommodate considerable relative translation of the trigger pin 310 with respect to the outer tube member $234_A$. The second, or slotted reaction aperture $314_A$ is located in the slider 250. In either embodiment, the trigger pin 310 causes the slider 250 (or $250_A$) to translate between the dog-blocking position and the dog-release position when the trigger pin 310 engages the first and second ends 316 and 318, respectively, of the slotted aperture 314 (or $314_A$).

A cover 320 is attached to the outer tube member 234 (or $234_A$) to prevent foreign objects from entering the working area of the adjusting mechanism 210. The cover 320 may be attached to the outer tube member 234 by appropriate means. As shown in the drawings, the cover 320 has a plurality of legs 322 that are frictionally fitted in a matching plurality of receiving slots 324 in the outer tube member 234.

OPERATION OF THE SECOND ALTERNATIVE EMBODIMENT OF THE PRESENT INVENTION

Operation of the adjusting mechanism may be readily comprehended by reference to an exemplary installation utilized to adjust a backrest 16. With reference first to FIG. 9, which depicts the incremental adjusting mode, it will be observed that the height of the backrest 16 (as represented by the attachment flange 235) may be readily adjusted simply by lifting the backrest 16 to the desired vertical disposition. In the incremental adjusting mode the outer tube member 234 is precluded from downward translation by virtue of the ratchet dog 246 which extends through the hole 302 in the first wall 260 of the outer tube member 234 to engage one of the ratchet recess means 248 in the insert 249 mounted through the first wall 252 in the inner tube member 252 (or to engage one of the ratchet recess means $248_A$ in the first wall $252_A$ of the inner tube member 232). The ratchet dog 246 (or $246_A$) thus serves as a shear member which forecloses downward translation of the outer tube member 234 with respect to the inner tube member 232. As such, the backrest 16 is secured against downward movement.

In the incremental adjusting mode the slider 250 is in its upper, or dog-release, position, and to increase the height of the backrest 16 one simply lifts the backrest 16. Lifting the backrest 16 when the adjusting mechanism 210 or $210_A$ is in the incremental adjusting mode causes the outer tube member 234 to move upwardly with respect to the inner tube member 232. This upward translation is achieved because the beveled edge 304 on the upper side of the ratchet dog 246 acts as a cam follower when it engages the ratchet recess means 248 (or $248_A$) while moving upwardly, as best shown in FIG. 9, thus driving the ratchet dog 246 out of the ratchet recess means 248 (or $248_A$) against the biasing action applied to the ratchet dog 246 by the bottom portion 300 of the spring 244. When the ratchet dog 246, which remains slidably received within the hole 302 aligns with the next upwardly successive ratchet recess means 248 (or $248_A$), the biasing action of the spring 244 urges the ratchet dog 246 into engagement with the next successively aligned recess means 248 (or $248_A$). The backrest 16 is then once again locked against downward translation. That process may be repeated until the backrest 16 is located at the desired height.

It should be understood, however, that at each incremental height the ratchet dog 246 acts as a shear pin which precludes downward translation of the backrest 16.

To lower the backrest 16, the backrest 16 must first be raised to its uppermost, or ratchet-disengaging, position, as shown in FIG. 10. As the backrest 16 approaches its uppermost, or ratchet-disengaging, position, the trigger pin 310 engages the first end 316 of the slotted reaction aperture 314. As the backrest 16 continues to be urged upwardly, engagement of the trigger pin 310 with the first end 316 of the slotted reaction aperture 314 translates the slider 250 downwardly with respect to the outer tube member 234 until the trigger pin 310 engages the lower, or second delimiting, aperture 313 (or $313_A$) of the slotted access aperture 312 (or $312_A$). When this occurs: the backrest 16 can no longer be raised; the outer tube member 234 is in its ratchet-disengaging position; and, the slider 250 is in the dog-blocking position.

The downward translation of the slider 250 effected by engagement of the trigger pin 310 with the first end 316 of the slotted reaction aperture 314 causes the blocking edge 330 in the U-shaped recess 306 of the slider 250 to wedge itself under the bottom section 300 of the spring 244, thus lifting the ratchet dog 246 out of engagement with the ratchet recess means 248 in the insert 249 (or the recess means $\mathbf{248}_A$ in the first wall $\mathbf{252}_A$ of the inner tube member $\mathbf{232}_A$). In either situation the slider 250 is in its dog-blocking position, and the backrest 16 may now be lowered because the dog 246 can not engage any of the ratchet recess means 248 (or $\mathbf{248}_A$). The bottom section 300 of the spring 244 remains deflected while the outer tube member 234 is lowered outside the inner tube member 232, because the blocking edge 330 of the slider 250 remains wedged under the bottom section 300 of the spring 244. In order to assure the desired penetration of the blocking edge 330 beneath the bottom portion 300 of the spring 244, the semi-circular concavity 332 in the blocking edge 330 will preferably embrace the ratchet dog 246.

When the backrest 16 approaches its lowermost position, the trigger pin 310 engages the other end 318 of the slotted reaction aperture 314 such that continued downward movement of the backrest 16 forces the slider 250 to translate upwardly with respect to the outer tube member 234 to the dog-release position of the slider 250, as represented in FIG. 11. As the slider 250 translates upwardly, the blocking edge 330 thereon is removed from between the bottom section 300 of the spring 244 and the slider 250, permitting the spring 244 to bias the ratchet dog 246 once again into engagement with one of the ratchet recess means 248 (or $\mathbf{248}_A$). The slider 250 is now in its upper, or dog-release, position, and the outer tube member 234 is in its ratchet-engaging position, as represented in FIG. 9. Overtravel of the slider 250 is precluded by having the trigger pin 310 engage the upper, or first delimiting, end 311 (or $\mathbf{311}_A$) of the slotted access aperture 312 (or $\mathbf{312}_A$). Thus, when the backrest 16 is raised, the ratchet dog 246 will once again engage the successive recess means 248 (or $\mathbf{248}_A$), and the backrest 16 will be restrained against downward movement, but the user of the chair may then lift the backrest 16 to the desired height.

While a preferred embodiment as well as an alternate embodiment and a variation of the alternate embodiment of my present invention are disclosed, it is to be clearly understood that the embodiments are susceptible to numerous changes apparent to one skilled in the art. Therefore, the scope of the present invention is not to be limited to the details shown and described but is intended to include all changes and modifications which come within the scope of the appended claims.

As should now be apparent, the present invention not only teaches that an adjusting mechanism embodying the concepts of the present invention effectively utilizes an unobtrusive ratcheting arrangement that automatically engages when the component to be adjusted is at its lowermost position and automatically disengages when that component is at its uppermost position, but is also capable of accomplishing the other objects of the invention.

I claim:

1. An adjustment mechanism for furniture components said mechanism comprising:

(a) a first member having a plurality of ratchet recesses therein;

(b) a ratchet dog supported by a second member; said first and second members being positioned in alignment and being advanceable between a retracted alignment and an extended alignment relative to each other; said ratchet dog successively aligning with respective ones of said ratchet recesses as said first and second members are advanced between said retracted and extended alignments;

(c) a spring engaging said ratchet dog and urging said ratchet dog into the respective ratchet recess aligned with said ratchet dog;

(d) blocking means advanceable into a dog blocking position for preventing advancement of said ratchet dog into said ratchet recesses;

(e) first means on said adjustment mechanism for advancing said blocking means into said blocking position when said first and second members are advanced to said extended alignment; and (f) second means on said adjustment mechanism for advancing said blocking means out of said dog blocking position when said first and second members are advanced to said retracted alignment.

2. The adjustment mechanism as in claim 1 wherein:

(a) said spring is secured to said second element; and (b) said blocking means comprises a blocking member having a blocking portion which blocking portion is wedged between said second member and said spring when said blocking means is advanced to said dog blocking position such that said blocking portion lifts a section of said spring away from said second member to prevent said spring from urging said ratchet dog into said ratchet recesses.

3. The adjustment mechanism as in claim 2 wherein:

(a) said ratchet dog is connected to said section of said spring.

4. The adjustment mechanism as in claim 1 wherein:

(a) said blocking means includes a hook extending outward therefrom, a blocking portion and a prong extending past said blocking portion;

(b) said first means comprises a first stop mounted on said first member and engaging said hook as said first and second members are advanced toward said extended alignment, engagement of said hook by said first stop as said first and second members are advanced to said extended alignment advances said blocking means into said dog blocking position; and (c) said second means comprises a second stop mounted on said first member and engaging said prong as said first and second members are subsequently advanced toward said retracted alignment; engagement of said prong by said second stop as said first and second members are advanced to said retracted alignment advances said blocking means out of said dog blocking position.

5. An adjustment mechanism for furniture components, comprising:

(a) a first member having a plurality of ratchet recesses therein;

(b) a ratchet dog supported by a second member; said first and second members being positioned in alignment and being advanceable between a retracted alignment and an extended alignment relative to each other; said ratchet dog successively aligning with said ratchet recesses as said first and second members are advanced between said retracted and extended alignments;

(c) a spring engaging said ratchet dog and urging said ratchet dog into the respective ratchet recess aligned with said ratchet dog;

(d) a blocking member movably attached to said second member and including a blocking portion which is advanceable into and out of a dog blocking position relative to said spring wherein said blocking portion, in said blocking position, prevents said ratchet dog from advancing into said ratchet recesses;

(e) a first stop mounted on said first member and engaging said blocking member as said first and second members are advanced toward said extended alignment so as to advance said blocking portion of said blocking member into said dog blocking position as said first and second members are further advanced to said extended alignment; and (f) a second stop mounted on said first member and engaging said blocking member as said first and second members are advanced toward said retracted alignment so as to advance said blocking portion of said blocking member out of said dog blocking position as said first and second members are further advanced to said retracted alignment.

6. The adjustment mechanism as in claim 5 wherein:

(a) said spring is secured to said second member; and (b) said blocking portion of said blocking member is wedged between said second member and said spring when said blocking portion is advanced to said dog blocking position such that said blocking portion lifts a section of said spring away from said second member to prevent said spring from urging said ratchet dog into said aligned ratchet recesses.

7. The adjustment mechanism as in claim 6 wherein:

(a) said ratchet dog is connected to said section of said spring.

8. The adjustment mechanism as in claim 5 wherein:

(a) said blocking member includes a hook extending outward therefrom and a prong extending past said blocking portion thereof;

(b) said first stop engages said hook as said first and second members are advanced toward said extended alignment for advancing said blocking portion of said blocking member into said dog blocking position; and (c) said second stop engages said prong as said first and second members are subsequently advanced toward said retracted alignment for advancing said blocking portion of said blocking member out of said dog blocking position.

* * * * *